US006261369B1

(12) United States Patent
Morando

(10) Patent No.: US 6,261,369 B1
(45) Date of Patent: Jul. 17, 2001

(54) SINK ROLL FOR GALVANIZING BATH

(75) Inventor: Jorge A. Morando, Cadiz, KY (US)

(73) Assignee: Alphatech, Inc., Cadiz, KY (US)

( * ) Notice: Subject to any disclaimer, the term of this patent is extended or adjusted under 35 U.S.C. 154(b) by 0 days.

(21) Appl. No.: 09/427,446

(22) Filed: Oct. 27, 1999

(51) Int. Cl.[7] ..... B05C 19/02

(52) U.S. Cl. ..... 118/423; 118/DIG. 15; 118/419

(58) Field of Search ..... 118/423, DIG. 15, 118/419, 244, 420, 258; 492/47, 16, 17

(56) References Cited

U.S. PATENT DOCUMENTS 3,091,217 * 5/1963 Seymour .

5,538,559 * 7/1996 Kleinmeyer et al. ..... 118/423

* cited by examiner

*Primary Examiner*—Brenda A. Lamb
(74) *Attorney, Agent, or Firm*—Charles W. Chandler

(57) ABSTRACT

A roll apparatus for use within a bath of molten metal which has a first and second support arm with a pair of openings aligned along an axis, a strip engaging roll having an axial bore and a length as great as the width of the moving metal strip which passes around the roll, a shaft telescopically received in the roll and having a first end disposed in a first of aligned openings and a second end disposed in the other of the aligned openings and a structure carried on at least one of the arms engaging the shaft such that the shaft is axially movable in the aligned openings but non-rotatable with respect to the arms.

14 Claims, 4 Drawing Sheets

SINK ROLL FOR GALVANIZING BATH

BACKGROUND OF THE INVENTION

A moving strip of metal is submerged in a pool of molten zinc or zinc aluminum alloy in galvanizing and aluminizing processes. As the strip is lowered into the molten metal, it passes beneath a submerged horizontal sink roll to reverse its direction of motion. The sink roll rotates on end trunnions carried by a pair of vertical arms that have their lower portions submerged in the molten metal. Typically, this type of arrangement is illustrated in FIGS. 1 and 2.

Certain conditions reduce the life of the support arms and the trunnions. One condition is that the submerged lower ends of the arms heat up to about 900° F. and become relatively soft. Distortion takes place because the arms are partially submerged. The arm strength is reduced. For this reason, the arms warp either toward or away from the roll ends, because of the upward load on the roll by the moving strip tension, as shown in the dashed lines in FIG. 1. The arms may move either outwardly or inwardly. FIG. 1 is an exaggerated illustration of the warping process.

The horizontal trunnions and the roll bearings initially start out with a line contact as the trunnions are rotated. However, as the heated arms bend from the vertical, the trunnions bend downwardly worsening the loss of their line contact. The resulting point contact causes early bearing wear.

Although the bearing clearance should be about 0.005 to 0.010 inches for the best performance, the tendency is for the user to increase the clearance between the bearing and the trunnion, for example, to a 0.25 to 0.50 inch clearance. This larger clearance prevents seizure of the trunnions and the bearings under this deformation. However, a large clearance increases the distortion and permits dross to build up in the bearings, which in turn causes additional erosion and life reduction. In effect, the bearing is self-destructing. Dross is an alloy of the molten metal.

One solution for extending trunnion life and therefore roll life is to provide a self-aligning bearing which will accommodate the deformation of the trunnions. Such a bearing is described in my U.S. Pat. No. 5,549,393. Self-aligning bearings follow the deformation of the arms and trunnions to maintain a line bearing contact. The trunnion cannot machine the contact surface of the bearing. However, it is not always feasible to use self-aligning bearings.

A solution to this bearing problem for those installations that do not use my self-aligning bearings is an object of this invention. Since part of the problem results from the trunnion rotating while the arm is deforming, I have found that a non-rotating shaft which can axially move and will accommodate arm warping. Clearances are not critical because the shaft is not rotating. The arm, in the preferred embodiment, has a bore that allows for relative axial, angular and radial motion between the bore in the arm and the non-rotating shaft.

A stop plate mounted on the arm has a tongue that is received in an opening in the shaft to prevent rotation of the shaft without imposing bending stresses.

A spacer is shrink-fitted in the roll. The roll and the spacer rotate on the shaft that is maintained straight by the metal strip, and its tension. The metal strip engages the roll as the strip is reversing direction in the molten metal bath. The stresses due to elastic and thermal deformation affecting the running area concentricity and angularity, are so reduced that the clearance can be reduced dramatically, for example, to about 0.010 to 0.020 inches versus 0.250 inches to 0.475 inches used in the current state of the art designs. This small clearance allows the formation of hydrodynamic films to further reduce the coefficient of friction and wear, also limiting the size of the contamination, such as dross, that can enter the bearing contact areas.

The availability of AT-103 series alloys makes it possible to design a self-contained, self-aligning galvanizing roll using roller bearings in molten metal. Because sliding friction is eliminated, this design can carry a very heavy roll, accommodate a very high tension from the strip, and permit very high speeds with negligible friction losses or slip with respect to the strip velocity.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
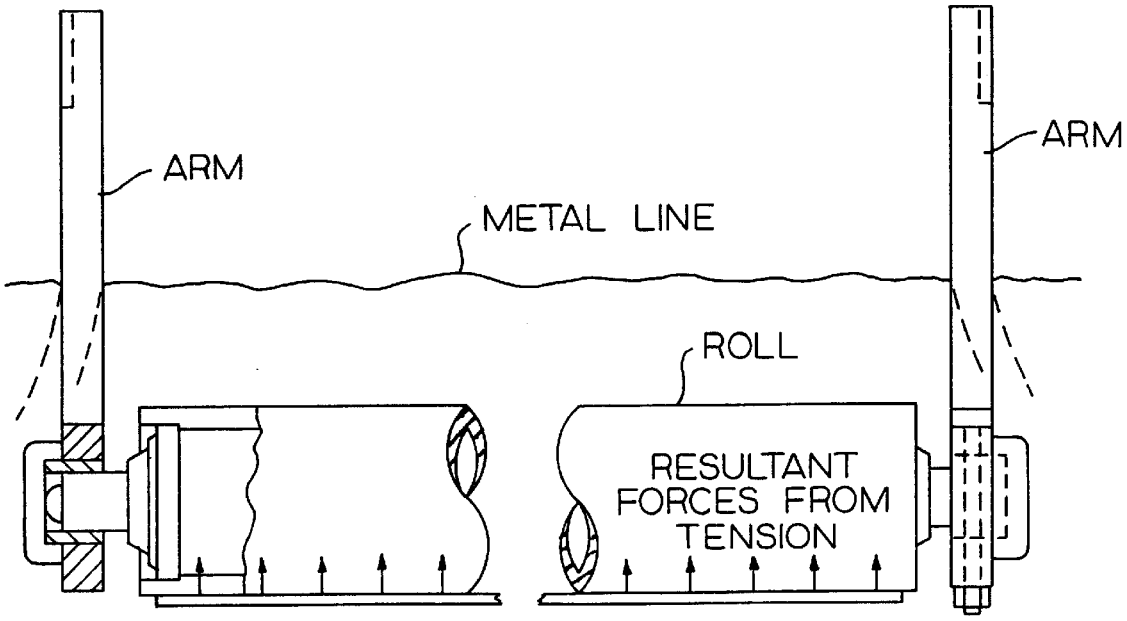
PRIOR ART FIG. 1
FIGS. 1 and 2 illustrate the problems that occur in certain prior art installations.
Figure 2:
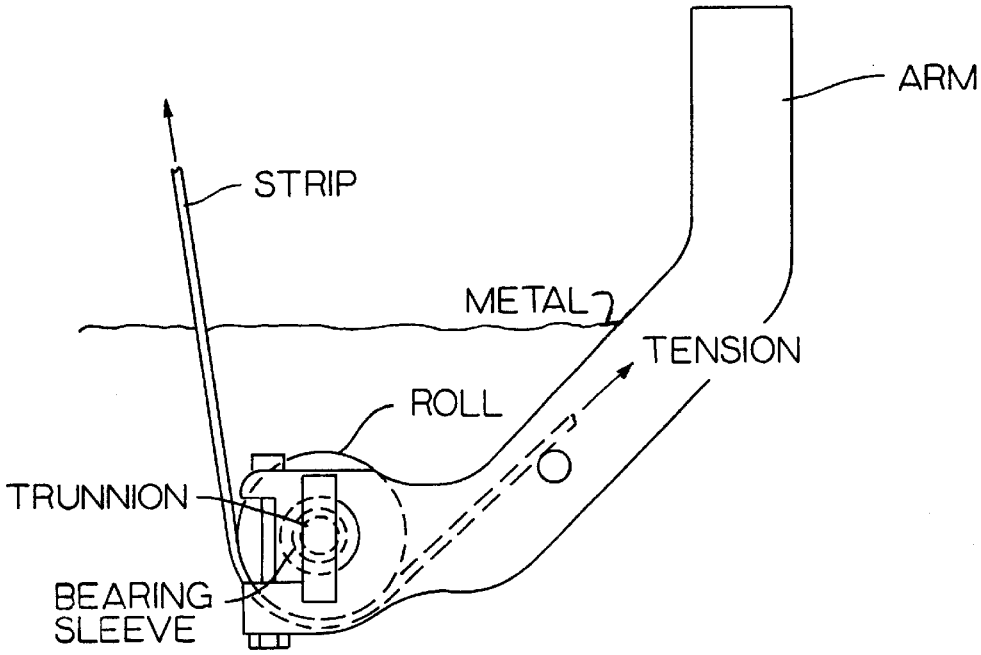
PRIOR ART FIG. 2
Figure 3:
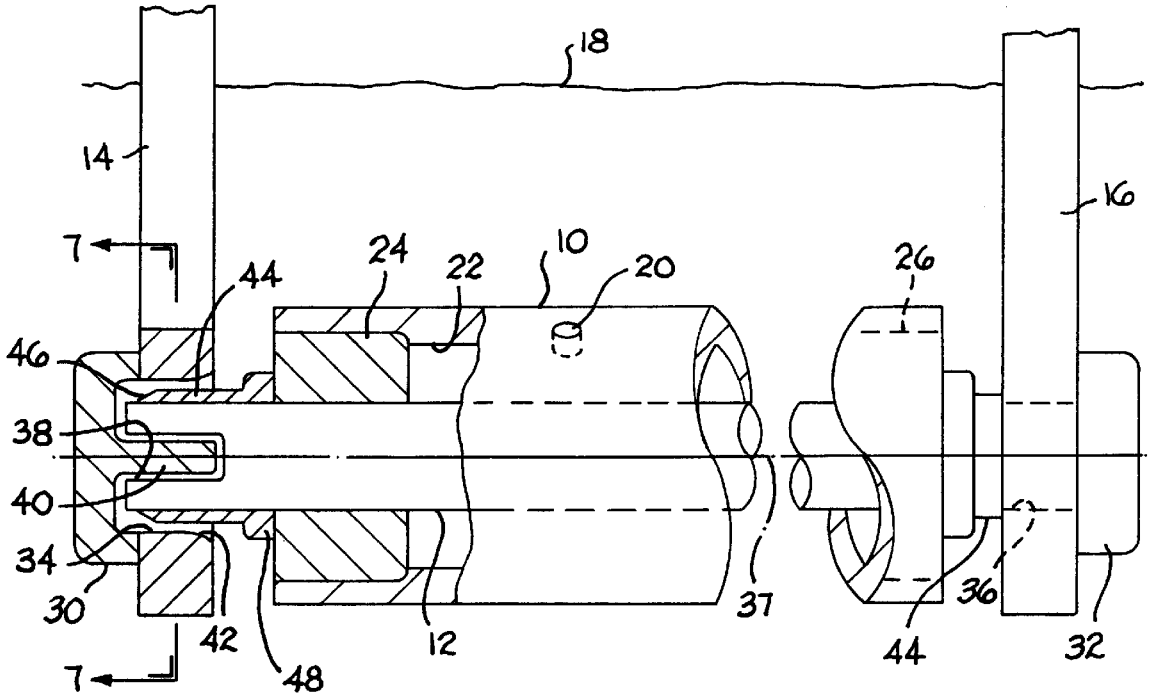
FIG. 3 is a fragmentary sectional view of one embodiment of the invention.

Referring to the drawings, FIG. 3 illustrates one embodiment of the invention in which a roll 10 is supported by a shaft 12 mounted between a pair of arms 14 and 16. The lower part of the arms, the roll and the shaft are disposed in a bath of molten aluminum having a metal line 18. For illustrative purposes, the roll has a diameter of 24 inches and is 80 inches long. It is formed of an AT-103C alloy steel. The roll has a vent drain 20, which provides a fluid passage between the bath and the interior of the roll.

Shaft 12 is also formed of an AT-103C alloy steel and, for illustrative purposes, is longer than the length of the roll. The shaft is disposed within the internal bore 22 of the roll.

A pair of spacers 24 and 26 are mounted in the ends of the roll. The spacers are formed of an AT-103C or AT-103A alloy so as to have the same coefficient of thermal expansion as the roll. The length and the diameter of each spacer is chosen to accommodate the tension forces applied to the moving strip, not shown, on the roll. Each spacer is shrink fitted inside the roll and slidably rotates on the shaft.

Figure 7:
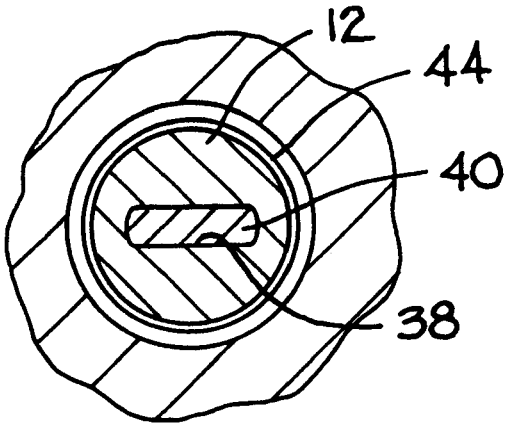
FIG. 7 is a view as seen along lines 7—7 of FIG. 3.

Referring to FIGS. 3 and 7, a pair of stop plates 30 and 32 are welded to the two arms around a pair of internal bores 34 and 36 which receive the ends of the shaft. Each end of the shaft has an internal end opening 38. Each stop plate has a tongue 40 received in an opening 38 to prevent rotation of the shaft.

Figure 8:
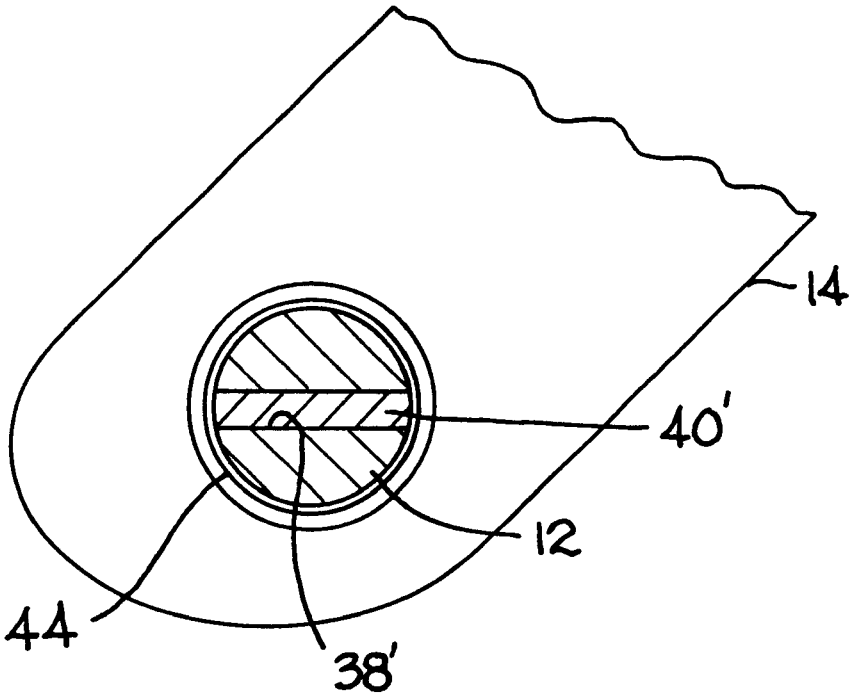
FIG. 8 is a view similar to FIG. 7 but shows an alternative slot for receiving a stop plate tongue.

FIG. 8 shows a variation of opening 38 in the form of a slot 38' that passes through the end of shaft 12 to receive tongue 40'.

The two bores 34 and 36 in the two arms are aligned along an axis 37 and have a diameter larger than that of the shaft. Each bore has a tapered section 42 about 0.25 inch in length to accommodate relative movement between the shaft and the arms.

A thrust sleeve 44 is shrink-fitted onto each end of the shaft, and formed of a material having the same coefficient of thermal expansion as the shaft, such as AT-103C or AT-103A. Each thrust sleeve has an outer end with a slight curvature at 46 to prevent jamming or scoring. The shaft can self-align itself with respect to the bores in the arms. Each thrust sleeve has an integral, annular flange 48, about 0.75 inch thick with a sufficient clearance to accommodate motion between the roll and the spacer.

A diametrical clearance at 50 is formed between the spacer and the shaft to form a hydrodynamic bearing lubricated by the molten zinc or zinc-aluminum alloy. The galvanizing alloy can pass between flange 48 into the clearance at 50 and out orifice 20 to lubricate and further extend the life of the spacer.

Figure 4:
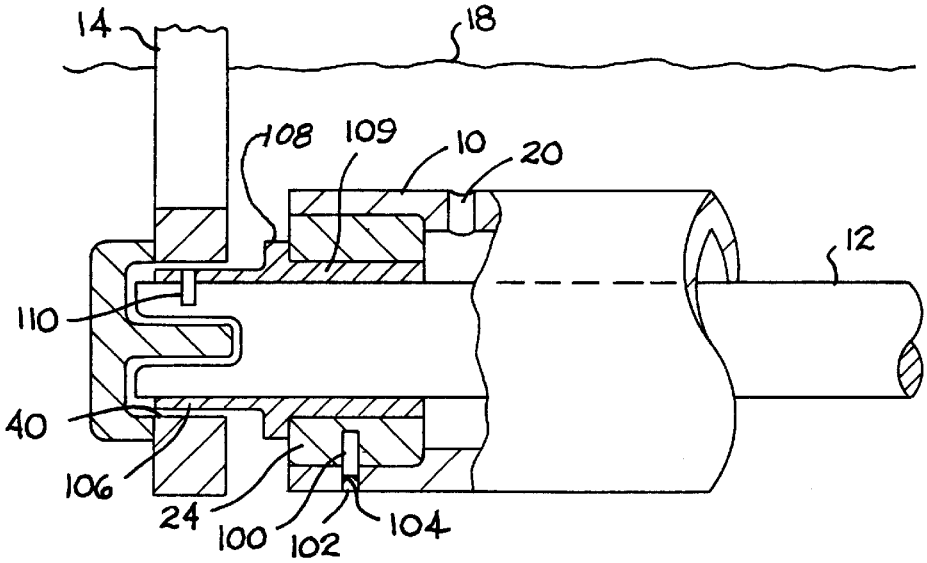
FIG. 4 is a view of another embodiment of the invention.

FIG. 4 illustrates a modification of the embodiment of FIG. 3. In this case, spacer 24 is not shrink fitted into the roll, but is connected by a pin 100 that extends through an opening 102 in the roll and the spacer. The pin is welded in place by welding material 104. For maintenance purposes, the spacer can be replaced by removing pin 100.

Thrust sleeve 106 has an annular flange section 108 that is slip fitted on the shaft, and then pinned in place by a pin 110. By removing the pins from the thrust sleeves at opposite ends of the roll, the shaft can be passed through bore 40 of the arm to replace the thrust sleeve. Thrust bearing flange 108 is made of a AT-103C or AT-103A alloy material to accommodate any chemical reaction between the roll materials and the molten galvanizing alloy.

Each thrust sleeve has an annular cylindrical section 109 that is mounted on the shaft within the spacer to provide a larger diameter sliding area between each spacer and the shaft. FIG. 4 represents the preferred embodiment of the invention.

Figure 5:
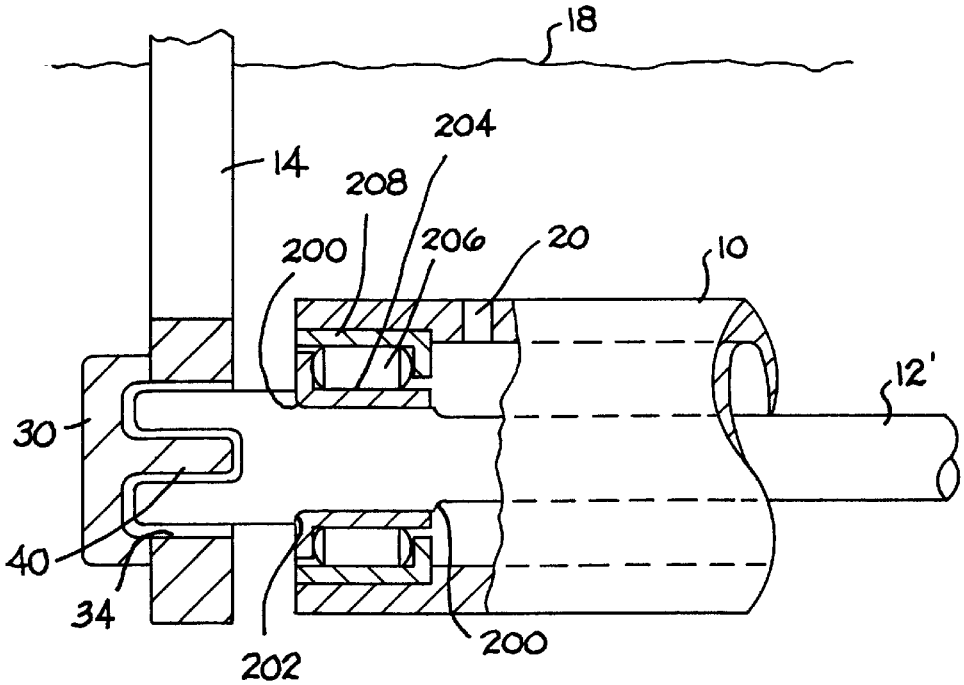
FIG. 5 is a view of still another embodiment in which roller bearings support the roll.

FIG. 5 illustrates another embodiment of the invention. In this case, each end of shaft 12' has been machined to provide an annular shoulder 200 and a second annular shoulder 202 which are spaced a distance to accommodate the inner race 204 of a roller bearing having a plurality of roller means 206 which roll inside an outer race 208. An outer race is pressed into each end of roll 10. As in the other embodiments, the shaft is non-rotatable with respect to the support arms. Stop 30 prevents the shaft from rotating but accommodates axial alignment of the shaft with respect to the support arms.

The roll can rotate at a very high rpm, such as 1000 rpm, with reduced friction and wear. The designed length of the bearing cage and the roller diameter depends upon the strip tension on the roll and the roll velocity (rpm).

Figure 6:
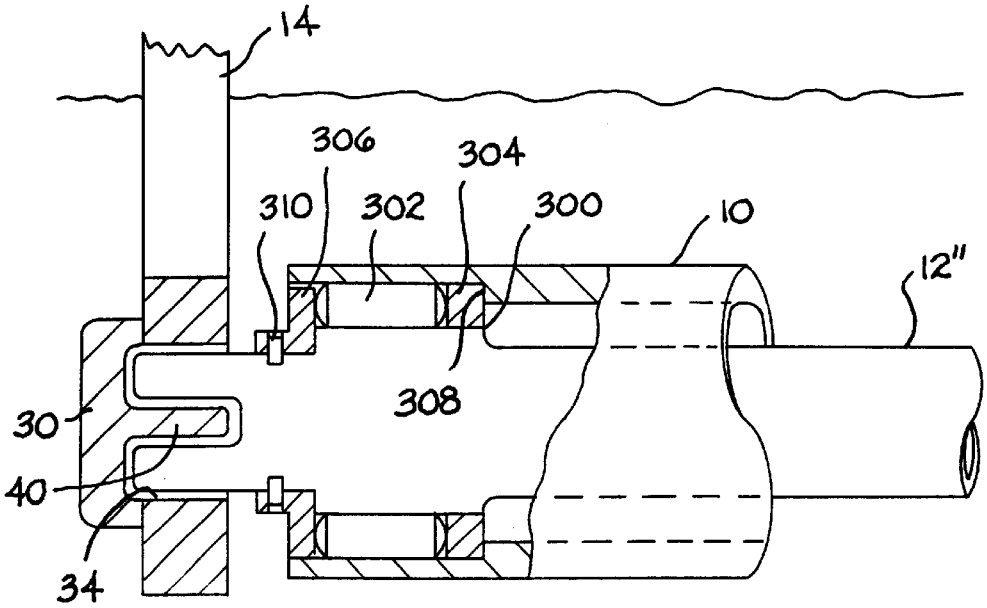
FIG. 6 is a still further embodiment of the invention.

FIG. 6 illustrates still another embodiment of the invention in which roll 10 is mounted on arm 14, the opposite end of the roll being identical to the roll end and arm illustrated in FIG. 6. In this case, shaft 12" is machined to form a ridge 300 for accommodating a plurality of annularly spaced rollers 302 trapped between an inner annular retainer 304 and an outer annular retainer 306. The inner retainer is located by a shoulder 308 in the bore of the roll, while the outer retainer is locked in position by pin means 310 to prevent the roller bearings from axially moving with respect to the shaft. The inner surface of the roll and the shaft cooperate in forming a cage for the rollers.

In each of the embodiments of the invention, the arms are partially submerged in the molten metal and support a non-rotating but axially moveable shaft. The strip passing through bath rotates roll 10 about the non-rotating shaft.

Having described my invention, I claim:

1. Roll apparatus for use within a bath of molten metal, in which a moving metal strip, under tension, is passed down into the bath of molten metal, and reverses direction by passing around a roll, the strip having a width, said apparatus comprising:

a first support arm, and a second support arm spaced from the first support arm a distance greater than the width of the moving metal strip, the first and second support arms having lower portions thereof disposed in the bath of molten metal, and having a pair of openings aligned along an axis;

a strip-engaging roll having an axial bore and a length at least as great as the width of the moving metal strip, disposed between the lower portions of the support arms for rotation about said axis;

a shaft telescopically received in the roll and having a first end disposed in a first of said aligned openings, and a second end disposed in the other of said aligned openings; and structure carried on at least one of said arms engaging the shaft such that the shaft is axially moveable in said aligned openings, but non-rotatable with respect to the arms.

2. Apparatus as defined in claim 1, including bearing means disposed in the roll bore and attached to the roll for rotating slidably engaging the shaft.

3. Apparatus as defined in claim 1, including bearing means disposed between the shaft and the roll comprising a spacer shrink-fitted in the roll bore.

4. Apparatus as defined in claim 3, in which the bearing means comprises first and second spacers disposed adjacent opposite ends of the roll bore.

5. Apparatus as defined in claim 1 including bearing means disposed between the roll and the shaft, the bearing means comprising roller bearing means mounted in the roll and around the shaft.

6. Apparatus as defined in claim 2, including a thrust sleeve mounted on the shaft between the bearing means and each of said arms.

7. Apparatus as defined in claim 1, including a stop plate attachment mounted on at least one of said support arms adjacent one of said aligned openings, and having a tongue engaging the shaft for preventing rotation thereof.

8. Apparatus as defined in claim 7, in which at least one end of the shaft has a tongue-receiving opening, and the stop plate has a tongue receivable in the tongue-receiving opening to prevent rotation of the shaft.

9. Apparatus as defined in claim 8, including a sacrificial thrust sleeve mounted on the shaft.

10. Apparatus as defined in claim 9, in which the thrust sleeve is slip fitted on the shaft, and including pin means for connecting the thrust sleeve to the shaft.

11. Roll apparatus for use within a liquid bath in which a moving strip under tension is disposed in the bath and reverses direction by passing around the roll, the strip having a width, said apparatus comprising:

a first support arm, and a second support arm spaced from the first support arm a distance greater than the width of the moving strip, the first and second support arms having portions there of disposed in the liquid bath and having a pair of openings aligned along an axis;

a strip-engaging roll having an axial bore and a length as least as great as the width of the strip, disposed between the aligned openings in the support arms for rotation about an axis;

a shaft telescopically received in the roll and having a first end disposed in a first of said pairs of aligned openings, and a second end disposed in the second of the pair of aligned openings; and structure carried on at least one of said arms engaging the shaft such that the shaft is axially moveable in said aligned openings, but non-rotatable with respect to the arms.

12. Roll apparatus for use within a bath of molten metal, in which a moving metal strip, under tension, is passed down into the bath of molten metal, and reverses direction by passing around a roll, the strip having a width, said apparatus comprising:

a strip-engaging roll having an axial bore and a length at least as great as the width of the moving strip;

support means for supporting the roll, the support means having a pair of spaced, axially aligned openings;

a shaft telescopically received in the roll and having a first end disposed in a first of the pair of aligned openings, and a second end disposed in the second of the pair of aligned openings, so as to be axially moveable with respect to the support means;

structure connecting the shaft to the support means such that the shaft is non-rotatable with respect to the support means; and roller bearing means mounted between the shaft and the roll such that the roll is rotatable about the shaft axis as the moving strip in the bath engages the roll.

13. Roll apparatus as defined in claim 12, in which the roller bearing means comprises a plurality of elongated bearing rollers disposed around the shaft and in the roll and having bearing axis parallel to the axis of the shaft, and including retainer means for preventing axial movement of the bearing rollers with respect to the shaft.

14. Roll apparatus as defined in claim 13, in which the retainer means comprises a first annular retainer connected to the shaft adjacent a first end of the bearing rollers, and a second retainer connected to the roll adjacent the opposite end of the bearing rollers.

* * * * *